US010227966B2

(12) United States Patent
Norman

(10) Patent No.: US 10,227,966 B2
(45) Date of Patent: Mar. 12, 2019

(54) EPICYCLICAL FLUID PUMP ASSEMBLY

(71) Applicant: Intelligent Energy Limited, Loughborough (GB)

(72) Inventor: Alexander David Norman, Cambridge (GB)

(73) Assignee: Intelligent Energy Limited, Loughborough (GB)

( * ) Notice: Subject to any disclaimer, the term of this patent is extended or adjusted under 35 U.S.C. 154(b) by 221 days.

(21) Appl. No.: 14/898,110

(22) PCT Filed: Jun. 25, 2014

(86) PCT No.: PCT/GB2014/051946
§ 371 (c)(1),
(2) Date: Dec. 11, 2015

(87) PCT Pub. No.: WO2014/207466
PCT Pub. Date: Dec. 31, 2014

(65) Prior Publication Data

US 2016/0138579 A1 May 19, 2016

(30) Foreign Application Priority Data

Jun. 26, 2013 (GB) ..... 1311362.6

(51) Int. Cl.
*F04B 43/12* (2006.01)
*F04B 45/08* (2006.01)
*F04B 9/02* (2006.01)

(52) U.S. Cl.
CPC ..... *F04B 43/12* (2013.01); *F04B 9/02* (2013.01); *F04B 43/1238* (2013.01);
(Continued)

(58) Field of Classification Search
CPC .. F04B 43/12; F04B 43/1253; F04B 43/1292; F04B 45/08
See application file for complete search history.

(56) References Cited

U.S. PATENT DOCUMENTS 3,816,035 A 6/1974 Malbec
5,718,568 A 2/1998 Neftel et al.
(Continued)

FOREIGN PATENT DOCUMENTS

DE 2651962 5/1978
DE 102010000592 6/2011
(Continued)

OTHER PUBLICATIONS

International Search Report and Written Opinion dated Sep. 29, 2014 in International Application No. PCT/GB2014/051946.
(Continued)

*Primary Examiner* — Bryan Lettman
(74) *Attorney, Agent, or Firm* — Baker Hostetler LLP

(57) ABSTRACT

A pump assembly includes a chamber, a compressible conduit along a periphery of the chamber, an elongated sun member within the chamber, and an elongated planet member arranged to orbit around the sun member. The sun member includes a first portion at one axial end having a gear and a second portion at the other axial end. The planet member includes a first portion at one axial end with a gear engaged with the gear of the sun member and a second portion at the other axial end configured to be engaged with a section of the compressible conduit to constrict the section. The first portion has a different texture from the second portion, and teeth of the gears on either the sun member or the planet member are retained in an axial direction by the second portion of the other of the sun member and planet member.

19 Claims, 2 Drawing Sheets

(52) U.S. Cl.
CPC ..... *F04B 43/1253* (2013.01); *F04B 43/1292* (2013.01); *F04B 45/08* (2013.01)

(56) References Cited

U.S. PATENT DOCUMENTS

| | | | | |
|---|---|---|---|---|
| 2004/0141863 | A1 | 7/2004 | Harada et al. | |
| 2005/0019186 | A1* | 1/2005 | Davis | F04B 43/086 417/477.1 |
| 2005/0129545 | A1* | 6/2005 | Prosek, Jr. | F04B 43/1253 417/474 |
| 2007/0217933 | A1* | 9/2007 | Haser | F04B 43/1238 417/477.2 |
| 2009/0074597 | A1* | 3/2009 | Martin | A61M 5/14232 417/477.1 |
| 2012/0282166 | A1* | 11/2012 | Wallace | C01B 3/06 423/652 |

FOREIGN PATENT DOCUMENTS

| | | | |
|---|---|---|---|
| EP | 0518290 | | 12/1992 |
| EP | 2036585 | A1 | 3/2009 |
| GB | 2138511 | A | 10/1984 |
| JP | 56-151289 | A | 11/1981 |
| JP | 2012-233427 | A | 11/2012 |

OTHER PUBLICATIONS

Great Britain Patent Application No. 1311362.6; Search Report; dated Jan. 14, 2014; 4 pages.

* cited by examiner

EPICYCLICAL FLUID PUMP ASSEMBLY

CROSS-REFERENCE TO RELATED APPLICATIONS

This application is a National Stage of International Patent Application No. PCT/GB2014/051946, filed Jun. 25, 2014 and claims priority to foreign application GB 1311362.2, filed Jun. 26, 2013, the contents of which are incorporated herein by reference in their entirety.

This invention relates to a pump assembly. In particular, it relates to a pump assembly for pumping fluids in a fuel cell system and/or a reactor for generating fuel for a fuel cell.

Pump assemblies are used to move fluids. Peristaltic pump assemblies are a type of pump assembly that includes a rotor and a pump head that is driven by the rotor and acts to compress a conduit containing the fluid. The movement of the head over the conduit drives fluid within the conduit. Pump assemblies are used in fuel cell systems to move fluids through the fuel cell and also in fuel source vessels or reactors, which house a reaction that generates fuel. Fuel reactors may use a reaction between a fuel source and an aqueous solution or water to generate a fuel, such as hydrogen. A pump may be required to pump the aqueous solution or water in such a fuel reactor.

According to a first aspect of the invention, we provide a pump assembly comprising:

- a chamber;
- a compressible conduit provided along a periphery of the chamber;
- a sun member provided within the chamber; and
- a planet member arranged to orbit around the sun member, the planet member having:
  - a first portion engaged with the sun member; and
  - a second portion configured to be engaged with a section of the compressible conduit in order to cause the section to be constricted, wherein the first portion has a different texture to the second portion.

This is advantageous as the texture of the first and second portion can be selected to effectively engage with the sun member and engage with the compressible conduit. Additionally, the diameter of the first and second portion can be selected so that there is no sliding contact between surfaces reacting the forces compressing the conduit, and hence the assembly has low friction and wear.

The sun member may comprise a drive member. Thus, rotation of the sun member may be arranged to transmit driving torque from the sun member to rotate the planet member which will thereby orbit the sun member. Therefore, the sun member transfers the motive force for the pump to the planet member and therefore to fluid in the conduit.

The pump assembly may include a motor, such as a stepper motor, for driving the drive member. The use of a stepper motor is advantageous as the risk of sparks is reduced compared with a brushed DC motor. Further, the steps of a stepper motor can be counted by control electronics to derive a measure of flow rate rather than requiring an encoder to measure the rotation.

The second portion may be smoother than the first portion. This is advantageous as the interface between the second portion and the conduit can be controlled such that the pump assembly has low friction for efficient operation. The first portion may be rougher than the second portion. The roughness of the first portion may assist it to engage the sun member.

The second portion may comprise a cylindrical roller that is co-axial with the first portion. The second portion may comprise a sleeve that extends around part of the first portion. The sleeve may be rotatably fixed to the first portion. Alternatively, it may be rotatable relative to the first portion.

The first portion may be spaced from the second portion along the axis of the planet member. Two first portions may be provided.

The sun member may have a first portion and a second portion, the first portion arranged to abut the first portion of the planet member and the second portion arranged to abut the second portion of the planet member. Drive provided by the sun member may be transmitted to the planet member via the first portions and the radial forces from the compressible conduit may be transmitted through the second portions (and possibly the first portions).

The first portion of the planet member and the sun member may each comprise a gear. The texture of the first portion therefore comprises projections in the form of teeth around the periphery of the first portion. The sun member may comprise a toothed gear that engages with the toothed, first portion of the planet member. The first portion may comprise a first gear part and a second gear part separated by the second portion. Likewise, the first portion of the sun member may comprise a first gear part and a second gear part separated by the second portion of the sun member.

The diameter of the second portion and the diameter/pitch circle diameter of the first portion of the planet member may be substantially equal. The diameter of the second portion and the diameter/pitch circle diameter of the first portion of the sun member may be substantially equal. This configuration is advantageous as forces in the pump are distributed effectively and there is low friction as the components roll over one another without sliding against one another.

The axis of the planet member may be parallel with an axis of the sun member. Thus, the rotational axis of the sun member and the rotational axis of the planet member are aligned.

The first portion may have a different diameter to the second portion. The first portion may have a larger diameter than the second portion.

The planet member is configured to occlude the section. Thus, the planet member may progressively occlude sections of the conduit as it moves across the conduit to drive fluid through the conduit. By occluding the section, the pump assembly may reduce the chance of reverse flow in the conduit.

The pump assembly may include an annulus arranged to engage with the first portion of the planet member. The annulus may surround the sun member and its orbiting planet member and may hold the assembly together.

The compressible conduit may be provided in an arc around the sun member. The planet member may therefore work between the compressible conduit and the sun member to provide the pumping force to fluid in the conduit.

The chamber may include a channel and the compressible conduit may be provided in the channel. The channel may be eccentric with respect to the axis of the sun member.

Optionally, the first portion of the sun member and the first portion of the planet member comprise a gear; and the second portion of the sun member and the second portion of the planet member are smooth; and the pitch circle diameter of the first portion is substantially equal to the diameter of the second portion for both the sun member and planet member. The sizing of the pitch circle diameter of the gear(s) relative to the diameter of the second portion may be used to restrict the axial movement of the sun member relative to the planet member. In particular, the teeth of the gears may be held axially by an edge of the second portion. Thus, the teeth of the gears on either the sun member or the planet member are retained, at least in part, in an axial direction, by the second portion of the other of the sun member and planet member.

The pump assembly may comprise a plurality of planet members. The planet members may be circumferentially spaced around the sun member.

The pump assembly may include a plurality of compressible conduits.

According to a further aspect of the invention, we provide a fuel cell system or fuel reactor for a fuel cell including the pump assembly of the first aspect of the invention.

The pump assembly is particularly suited to fuel cell applications as the sun member and planet member arrangement can provide compact gearing. A stepper motor can also be used to drive the sun member. This reduces the risk of sparks, which would be unacceptable in a flammable atmosphere. The amount of rotation of a stepper motor can be determined by the drive electronics that actuate the stepper motor rather than requiring an encoder to measure the amount of rotation. This allows for more precise control, which is advantageous in a fuel reactor and/or fuel cell systems.

There now follows, by way of example only, a detailed description of embodiments of the invention with reference to the following drawings.

Figure 1:
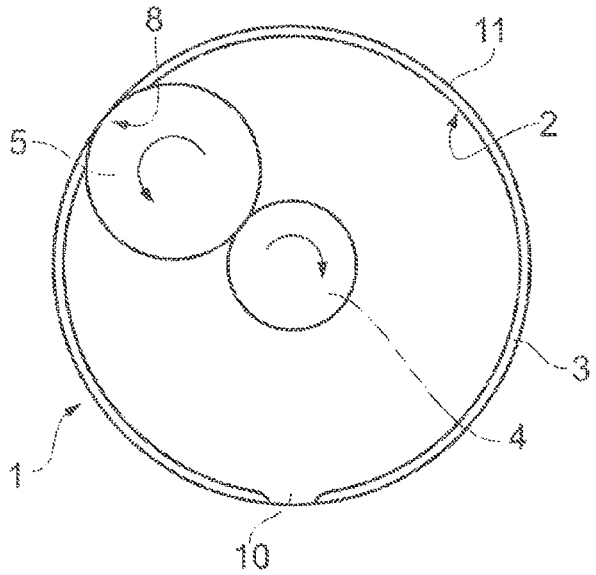
FIG. 1 shows a first exemplary embodiment of a pump assembly.

An embodiment of a pump assembly 1 is shown in FIG. 1. The pump assembly 1, in this embodiment, is for use in a fuel cell system to pump water. In particular, the pump assembly 1 is used to pump water in a fuel reactor for generating fuel for a fuel cell. It will be appreciated that the pump assembly 1 can be used for other applications and in other technical fields.

The pump assembly comprises a chamber 2 that houses a length of compressible conduit 3 provided along a periphery of an internal wall of the chamber 2. A rotatable sun member 4, which comprises a drive member for the pump assembly 1, is provided within the chamber. A planet member 5, driven by the sun member 4, is arranged to orbit around the sun member 4. The planet member 5 has a first portion 6 that engages with the sun member 4. The planet member also has a second portion 7 configured to engage the compressible conduit 3 in order to cause a section 8 of the conduit to be constricted. Thus, movement of the planet member 5 over the length of conduit 3 progressively constricts the conduit to provide the pumping force to fluid in the conduit. The first portion 6 has a different texture to the second portion 7.

The chamber 2 provides a housing for the sun member 4 and planet member 5. The chamber includes a channel or groove in its peripheral wall to receive the conduit 3. The channel locates the conduit 3 so that the second portion 7 of the planet member 5 can progressively constrict it as the planet member 5 orbits the sun member 6. The channel or chamber 2 includes an aperture 10, which allows the conduit 3 to enter and leave the chamber or provides for the connection of other conduits to the pump assembly, which receive the fluid pumped by the assembly through the conduit 3. The conduit is typically of plastics and comprises a tube.

The chamber 2 further includes an annulus 11 that forms an outer ring that engages with the planet member 5. Thus, the planet member 5 is held in place between the sun member 4 and the annulus 11 as it orbits the sun member 4.

The sun member 4 forms a drive member for the pump assembly and is powered by a stepper motor (not visible). The stepper motor includes control circuitry for actuating the stepper motor and reporting the number of steps the motor has performed. This information can be used to calculate the flow rate through the pump assembly 1. The sun member 4 is fixed in the chamber and rotates about its axis. The sun member 4 may be substantially cylindrical or disc-shaped. The sun member 4 may rotate about an axle or it may be mounted to a spindle of the motor. The control circuitry may be configured to calculate flow rate through the pump assembly. It will be appreciated that other types of motor may be used.

The planet member 5 comprises a substantially cylindrical or disc-shaped member. The planet member 5 may have the same or a different diameter to the sun member 4. The diameter of the sun member 4 relative to the diameter of the planet member 5 can be selected to provide the pump assembly with appropriate gearing for its application. The torque of a stepper motor is typically low and therefore the sun member may have a smaller diameter than the planet member.

Thus, the pump assembly is of peristaltic type. The pump assembly 1 has an epicyclical arrangement. The epicyclical arrangement provides gearing within the pumping mechanism itself without the need for an additional gear system. The planet members are free to rotate and orbit around the sun member rather than being mounted on a carrier that holds them in fixed relation to the sun member. However, the planet members may be mounted on a rotatable planet carrier if required.

Figure 2:
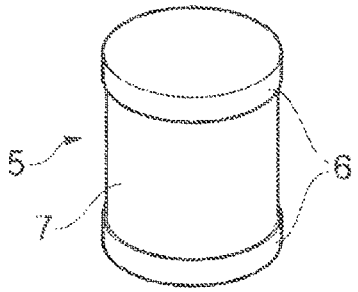
FIG. 2 shows a detailed view of a planet member of the pump assembly of FIG. 1.

With reference to FIG. 2, the first portion 6 is distributed over two ring shaped regions at both axial ends of the planet member 5. It will be appreciated that the first portion 6 may be located over other parts of the planet member 5. For example, the first portion may comprise only one band. The first portion 6 has a rough texture and may be of rubber, synthetic rubber or roughened plastics, for example. The rough texture of the first portion allows it to effectively engage with the sun member 4, and may prevent slipping between the sun member and the planet member. The first portion 6 also engages the annulus 11 and the rough texture allows it to effectively engage with the annulus.

The first portion 6 has a larger diameter than the second portion 7. The second portion 7 is located over a central region of the planet member 5 between the first portions 6. The second portion 7 has a smooth texture, different to the first portion 6. The smooth texture means that the friction between the second portion 6 and the conduit 3 is low. Thus, the second portion 6 can move freely over the conduit as it compresses it without causing undue wear on the conduit 3. The first portion 6 and the second portion 7 are in a rotationally fixed physical relationship with one another. In some examples, the planet member can be provided as a unitary component. Alternatively, the second portion may be able to rotate relative to the first portion.

In use, the stepper motor powers the sun member 4 to rotate it about its axis. The rotational motion is effectively transferred to the planet member 5 assisted by the friction due to the rough texture of the first portion 6. Rotation of the planet member 5 causes it to orbit the sun member, rolling along the annulus 11. As the planet member 5 orbits the sun member 5 its second portion 7 will constrict or compress 8 the conduit thereby moving fluid through the conduit 3. Preferably, the planet member 5 is configured to constrict the conduit 3 sufficiently to occlude the flow path through the conduit 3. This prevents or reduces reverse flow through the conduit 3 as well as effectively driving the fluid through the conduit 3. Thus, with each orbit of the sun member 4, the planet member 5 works the fluid through the length of conduit that enters the chamber 2, loops around it and exits the chamber 2 by the aperture 10. Accordingly, the planet member 5 rolls along the conduit 3 progressively occluding a section 8 which moves along the length of the conduit 3 to provide a pumping force to the fluid therein. This "constriction wave" provides an efficient and precise means for pumping fluid. The planet member 5 repeatedly constricts the conduit from a start point to an end point and then returns to the start point as it passes the aperture 10 with each complete orbit of the sun member 4.

Figure 3:
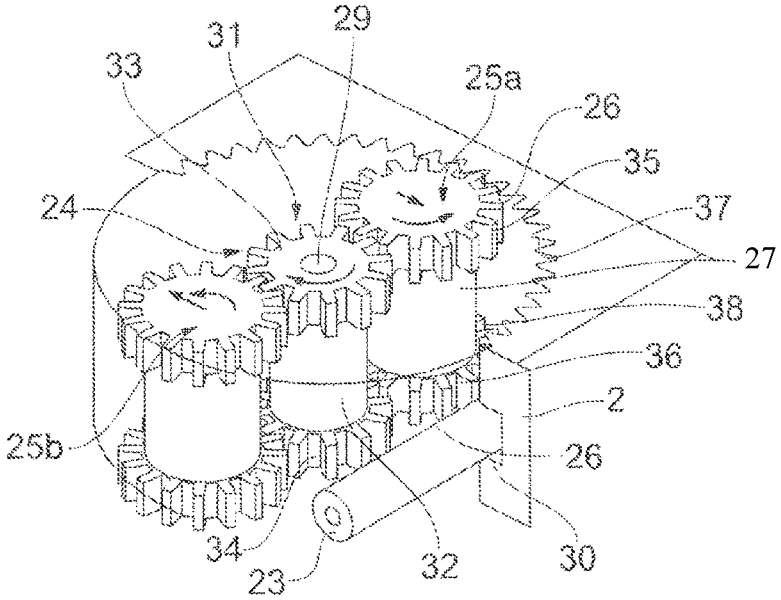
FIG. 3 shows a cut-away view of a second exemplary embodiment of a pump assembly.

FIG. 3 shows a further embodiment in which two planet members 25*a*, 25*b* are provided that are mounted on diametrically opposed sides of a sun member 24. The sun member 24 is driven by a stepper motor and is mounted on a spindle 29 thereof. A channel 30 is provided in which the conduit 23 is mounted.

In this embodiment, the sun member 24 includes a first portion 31 and a second portion 32 complimentary to the first and second portions on the planet members 25*a*, 25*b*. The first portion 31 of the sun member 24 comprises a gear. In particular, the gear has a first gear part 33 and a second gear part 34 at opposed ends of the sun member 24. The second portion 32 of the sun member 24 does not have teeth and is smoother than the first portion 31. The second portion 32 has the same diameter as the pitch circle diameter of the first and second gear parts 33, 34.

The planet members 25*a* and 25*b* have the same construction. The planet members 25*a* and 25*b* are substantially similar to the planet member 5 of the first embodiment and have a first portion 26 and a second portion 27. However, the first portion 26 includes two rings of teeth which form a pair of gears comprising a first gear part 35 and a second gear part 36. The first gear part 35 is located at a first axial end of the planet member 25*a*, 25*b* and the second gear part 36 is located at an opposed axial end of the planet member. The second portion 27 of the planet member 25*a*, 25*b* is smooth. Thus, the first and second portions 26, 27 have different textures; the first portion having projecting teeth of the gears and the second portion being smooth. The gear parts 35, 36 project radially and the second portion 27 has a diameter substantially equal to the pitch circle diameter of the gear parts 35, 36 of the first portion.

An annulus 37 is provided and also includes a plurality of inwardly facing teeth. In this embodiment, there is a second annulus 38 axially spaced from the first annulus 37. The conduit 23 extends within the channel between the two annuli 37, 38. The diameter of the loop of conduit 23 when it is in the compressed state may be such that it is substantially equal to the pitch circle diameter of the annuli 37, 38. Further the second portion of the planet members may roll along a path having this diameter. In this case, sliding friction between the planet member and the conduit is low.

Thus, the first gear part 33 of the sun member 4 meshes with the first gear part 35 of the planet members 25*a*, 25*b*. The first gear part 35 of the planet members 25*a*, 25*b* also meshes with the first annulus 37. Likewise, the second gear part 34 of the sun member 24 meshes with the second gear part 36 of the planet members 25*a*, 25*b*. The second gear part 36 of the planet members 25*a*, 25*b* also meshes with the second annulus 38. The second portion 27 of the planet members 25*a*, 25*b* abuts the conduit 3 as well as the second portion 32 of the sun member 4, which helps to distribute forces in the pump assembly 1. The provision of two gear parts either side of the smooth second portion on the sun and planet members is advantageous as this helps prevent twisting of the planet members in the assembly. Further the teeth of the gear parts of the sun member extend into a region defined by the circumference of the second portion of the planet member. Likewise, the teeth of the gear parts of the planet member extend into a region defined by the circumference of the second portion of the sun member. This overlap between the teeth of the sun/planet members with the second portion of the other of the sun/planet member helps to axial locate the sun and planet members relative to one another.

Operation of this embodiment is substantially similar to the first embodiment except that the rotation of the sun member 24 is transferred to the planet members 25*a*, 25*b* through the gear parts 33, 34; 35, 36. Also, the two planet members 25*a*, 25*b* work the fluid through the conduit 23 as they progressively move along the length of conduit. The forces compressing the conduit are reacted through the planet members 25*a*, 25*b* to the second portion 32 of the sun member 24. This is advantageous as the surfaces carrying the reaction forces from the conduit 3 are rolling, and therefore friction is low.

Figure 4:
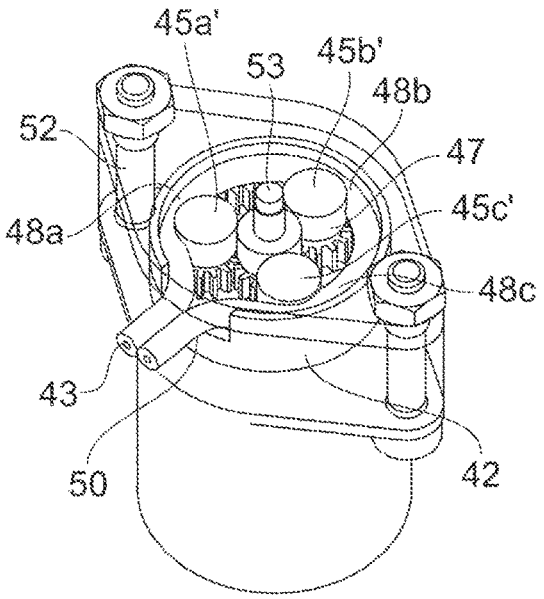
FIG. 4 shows a third exemplary embodiment of a pump assembly.
Figure 5:
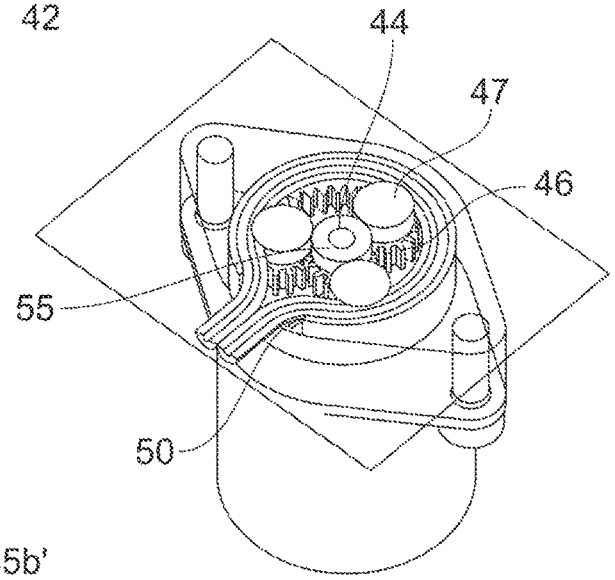
FIG. 5 shows section through the embodiment of FIG. 4 at a first depth.
Figure 6:
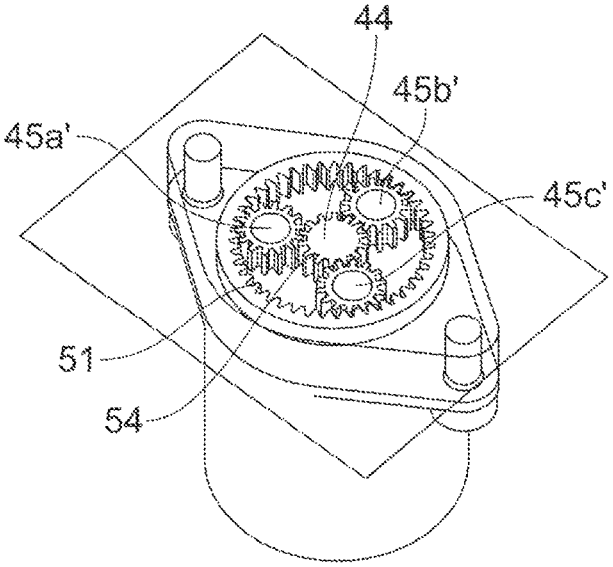
FIG. 6 shows section through the embodiment of FIG. 4 at a second depth.

FIGS. 4 to 6 show a further embodiment. FIGS. 5 and 6 show cutaway views of the pump assembly shown in FIG. 4 at different depths through the chamber 42 to clearly show the component parts of the assembly.

In this embodiment, three planet members 45*a*', 45*b*' and 45*c*' are provided, circumferentially spaced around a sun member 44. The planet members have the same construction and therefore only one, planet member 45*a*', will be described. The first portion 46 of the planet member 5*a*' comprises a gear. The first portion 46 is located at one axial end of the cylindrical planet member 45*a*'. The second portion 47 of the planet member 45*a*, which is located at an opposed axial end of the planet member is of smooth plastics. The diameter of the second portion 47 is substantially equal to the pitch circle diameter of the first portion 46. It will be appreciated that in other embodiments the diameters may differ.

An annulus 51 is provided comprising a ring of inwardly facing teeth for engaging with the first portion 46 of the planet members 45*a*', 45*b*' and 45*c*'. Accordingly, the annulus 51 is mounted in the base of the chamber 42 (most clearly shown in FIG. 6). The diameter of the loop of conduit 43, when it is in the compressed state may be such that it is substantially equal to the pitch circle diameter of the annulus 51. Further the second portion of the planet member may roll along a path having this diameter. In this case, sliding friction between the planet member and the conduit is low.

The conduit 43 enters the chamber 42 through the aperture 50 and loops around the internal wall of the chamber between the annulus 51 and a top chamber plate 52. The conduit leaves by the aperture 50. The conduit 43 is thus aligned with the second portions 47 of the planet members 45*a*', 45*b*' and 45*c*'. The second portions 47 each create an occlusion 48*a*, 48*b*, 48*c* in the conduit 43, which, as the planet members 45*a*', 45*b*' and 45*c*' orbit the sun member 4 provides the pumping force to move fluid through the conduit.

The sun member 44 is mounted on a spindle 53 and comprises a cylindrical drive member. The sun member 44 has a first portion 54 and a second portion 55. The first portion 54 comprises a gear at one axial end and the second portion 55 is smooth and arranged at an opposed axial end. The first portion 54 of the sun member 44 is arranged to mesh with the first portion 46 of the planet members 45*a*', 45*b*' and 45*c*'. The smooth second portion 55 of the sun member 44 also abuts the second portions 47 of the planet members 45*a*', 45*b*' and 45*c*'. The pitch circle diameter of the first portion 54 is equal to the diameter of the second portion 55. It will be appreciated that in other embodiments the diameters may differ.

In use, the operation of this embodiment is the same as previous embodiments. The sun member 44 receives power from a motor. The rotational motion of the sun member is transferred to the planet members 45*a*', 45*b*' and 45*c*' through the gears such that they rotate. The planet members 45*a*', 45*b*' and 45*c*' orbit the sun member 44 and roll along the conduit 43 to provide the pumping force. As the second portion of the 55 of the sun member 44 abuts the second portions 47 of the planet members 45*a*', 45*b*' and 45*c*', the reaction force from the compression of the conduit 43 is transferred through the planet members to the sun member by way of the first and second portions, which may help to distribute forces within the pump and provide for efficient operation.

In the above embodiments straight cut gears are used. However, helical gears may be provided on the sun and planet members. A first gear part of the sun/planet members may comprise a helical gear of a first helix angle and a second gear part of the sun/planet members may comprise a helical gear of a second helix angle, which may be opposite to the first helix angle. Providing different or opposite helix angles can aid axial location of the planet member(s) relative to the sun member. Alternatively or in addition, the sun/planet members may be provided with double helical gears.

The provision of a sun and planet members where the pitch circle diameter of the gear parts are equal to the diameter of the second portions is advantageous as this design distributes forces effectively and reduces sliding contact between components (except between the gear teeth), which may allow the pump to operate effectively without lubricants or bearings.

The invention claimed is:

1. A pump assembly comprising:

a chamber;

a compressible conduit provided along a periphery of the chamber;

an elongated sun member provided within the chamber; the sun member having:

a first portion comprising a first gear part at one axial end and a second gear part at the other axial end;

a second portion disposed between the first gear part and the second gear part;

an elongated planet member arranged to orbit around the sun member, the planet member having:

a first portion comprising a first gear part at one axial end engaged with the first gear part of the sun member and a second gear part at the other axial end; and a second portion disposed between the first gear part and the second gear part of the planet member, the second portion of the planet member configured to be engaged with a section of the compressible conduit in order to cause the section of the compressible conduit to be constricted;

wherein the first portion of the planet member has a different texture compared to the second portion of the planet member, wherein teeth of the first and second gear parts on either the sun member or the planet member are retained, at least in part, in an axial direction, by the second portion of the other of the sun member and the planet member, wherein the chamber further includes an annulus configured to contact the first gear part of the first portion of the planet member; and wherein the annulus is a first annulus, and the pump assembly further comprises a second annulus spaced axially from the first annulus, the second annulus being configured to contact the planet member.

2. The pump assembly of claim 1 in which the sun member comprises a drive member for providing a motive force to the planet member.

3. The pump assembly of claim 2 in which the drive member is driven by a stepper motor.

4. The pump assembly of claim 1 in which the second portions of the sun and planet members are smoother than the first portions of the sun and planet members.

5. The pump assembly of claim 1 in which the second portion of the planet member comprises a cylindrical roller that is co-axial with the first portion of the planet member.

6. The pump assembly of claim 1 wherein the second portion of the planet member is configured to occlude the section of the compressible conduit.

7. The pump assembly of claim 1 wherein the compressible conduit is provided in an arc around the sun member.

8. The pump assembly of claim 1 wherein the compressible conduit is provided in a channel in the chamber.

9. The pump assembly of claim 8 wherein the channel is eccentric with regard to the axis of the sun member.

10. The pump assembly of any preceding claim in which the pump assembly includes a plurality of planet members.

11. The pump assembly of claim 1 in which the pump assembly includes a plurality of compressible conduits to receive a pumping force from the planet members.

12. A fuel cell system comprising the pump assembly of claim 1.

13. A fuel reactor for supplying fuel to a fuel cell, the fuel reactor including the pump assembly of claim 1.

14. The pump assembly of claim 1, wherein the annulus includes a plurality of teeth, the plurality of teeth being configured to contact the first gear part of the first portion of the planet member.

15. The pump assembly of claim 1, wherein the conduit extends within a channel between the first annulus and the second annulus.

16. The pump assembly of claim 1, wherein the planet member contacts with the second annulus at the second gear part of the planet member.

17. The pump assembly of claim 1, wherein the teeth of the first and second gear parts of the sun member extend into a region defined by the circumference of the second portion of the planet member.

18. The pump assembly of claim 1, wherein the teeth of the first and second gear parts of the planet member extend into a region defined by the circumference of the second portion of the sun member.

19. The pump assembly of claim 1, wherein the first gear parts of the sun and planet members each comprise a helical gear of a first helix angle and the second gear parts of the sun and planet members each comprise a helical gear of a second helix angle, wherein the second helix angle is opposite to the first helix angle.

* * * * *